US007249651B2

(12) United States Patent
Broersma

(10) Patent No.: US 7,249,651 B2
(45) Date of Patent: Jul. 31, 2007

(54) SWIVELING SOUND-GATHERING EAR GUARD FOR MASKS AND HELMETS

(75) Inventor: Lester Broersma, Chula Vista, CA (US)

(73) Assignee: Brass Eagle, LLC, Bentonville, AR (US)

( * ) Notice: Subject to any disclaimer, the term of this patent is extended or adjusted under 35 U.S.C. 154(b) by 0 days.

(21) Appl. No.: 11/096,169

(22) Filed: Mar. 31, 2005

(65) Prior Publication Data

US 2005/0178610 A1 Aug. 18, 2005

Related U.S. Application Data

(62) Division of application No. 10/377,036, filed on Feb. 28, 2003, now Pat. No. 6,874,169.

(60) Provisional application No. 60/360,643, filed on Feb. 28, 2002.

(51) Int. Cl.
*A42B 1/08* (2006.01)

(52) U.S. Cl. ..... 181/129; 181/136; 181/133; 2/209; 2/423; 2/425

(58) Field of Classification Search ..... 181/136, 181/133, 129; 2/209, 423, 425
See application file for complete search history.

(56) References Cited

U.S. PATENT DOCUMENTS

| | | | | |
|---|---|---|---|---|
| 3,239,842 | A * | 3/1966 | Marchello | 2/422 |
| 3,496,854 | A * | 2/1970 | Hill et al. | 454/370 |
| 3,500,475 | A * | 3/1970 | Norimoto | 2/421 |
| 4,633,532 | A * | 1/1987 | Yagasaki | 2/424 |
| 4,958,697 | A * | 9/1990 | Moody | 181/129 |
| 5,696,356 | A * | 12/1997 | Dudley et al. | 181/136 |
| 6,065,157 | A * | 5/2000 | Felman | 2/209 |
| 6,347,412 | B1 * | 2/2002 | Dorman | 2/423 |

* cited by examiner

*Primary Examiner*—Lincoln Donovan
*Assistant Examiner*—Jeremy Luks
(74) *Attorney, Agent, or Firm*—Keisling Pieper & Scott PLC; David B. Pieper; Trent C. Keisling

(57) ABSTRACT

A portion of a mask or helmet covering a user's ear has an aperture covered by a sound-collecting and sound-transmissive protector swivelingly mounted thereon. The protector has a substantially parabolic reflector surface oriented substantially perpendicular to the protector's axis of rotation which magnifies sounds arriving from a particular angular direction and directs the sound through a plurality of holes axially penetrating through the protector from an outer to an inner surface. A user manipulable actuator nib extends axially outwardly from a peripheral portion of the outer surface of the protector allowing user control of swiveling movement.

2 Claims, 1 Drawing Sheet

SWIVELING SOUND-GATHERING EAR GUARD FOR MASKS AND HELMETS

PRIOR APPLICATION

This is a divisional of U.S. patent application Ser. No. 10/377,036, filed Feb. 28, 2003, now U.S. Pat. No. 6,874, 169 issued Apr. 5, 2005, which claims the benefit of U.S. Provisional Patent Application No. 60/360,643 filed Feb. 28, 2002.

FIELD OF THE INVENTION

This invention relates to mask and helmet design and manufacture, and more particularly to masks used in the practice of various types of sporting activities such as hockey, baseball, motor-cross, and paintball war games.

BACKGROUND

Many sport practitioners must shield parts of their bodies against harmful impacts. In particular, hockey, baseball, motor-cross and and paintball enthusiasts, commonly wear protective masks or helmets which cover and protect their entire heads from such impacts. Such covering, though protective, tends to restrict the passage of sound therethrough. Hearing sounds from the field of play can often determine the next move a player will make. It is therefore important that sound attenuation caused by the mask be minimized.

Existing designs such as those for baseball helmets, provide holes through the mask walls near the user's ears for sound passage. However, in many sports and in motor-cross and paintball gaming in particular, such holes would allow an inordinate amount of either mud or paint through to the user's ear. Further, these existing designs do not selectively boost sounds coming from a particular direction and attenuate sounds from other directions. Further, a user cannot adjust the direction of sound selectivity apart from movement of the user's head.

The present invention results from an attempt to accommodate both ear protection and the adequate passage of sound while providing some user control of sound direction selectivity.

SUMMARY

The principal and secondary objects of this invention are to provide a sports mask or helmet which shields the user's ear from debris while allowing adequate passage of sound therethrough.

The instant embodiments provide a sound-collecting and transmissive protector swivelingly mounted within a circular aperture of a helmet proximate to a user's ear. The protector incorporates a substantially parabolic reflector surface oriented to boost sound pressure levels arriving from a particular direction which is generally perpendicular to the direction which is normal to the surface of the mask. The disk-shaped protector has a series of holes which allow passage of the sound therethrough and a user-manipulable actuator nib positioned on a peripheral portion of the protector to direct rotational movement.

DESCRIPTION OF THE PREFERRED EMBODIMENTS

Figure 1:
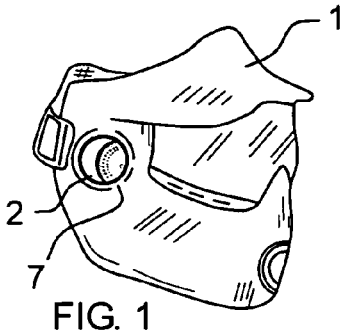
FIG. 1 is a is a diagrammatic perspective view of a first embodiment of the protector as mounted to a paintball mask.
Figure 2:
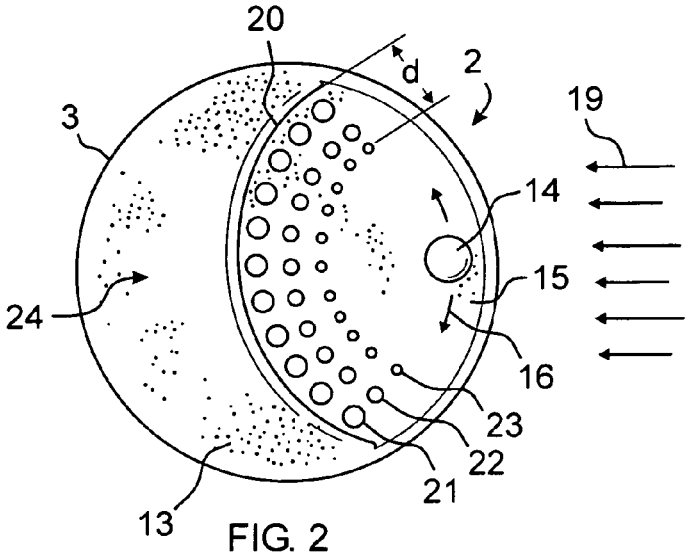
FIG. 2 is a diagrammatic outside plan view of a the protector of FIG. 1.
Figure 4:
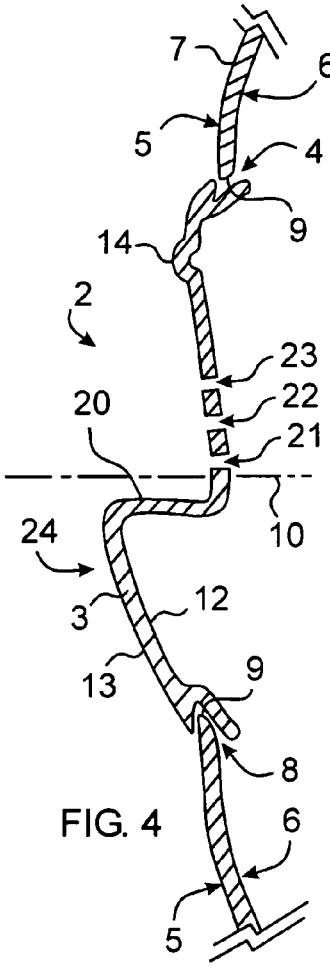
FIG. 4 is a diagrammatic cross-sectional bottom view of the protector shown in FIG. 1.
Figure 3:
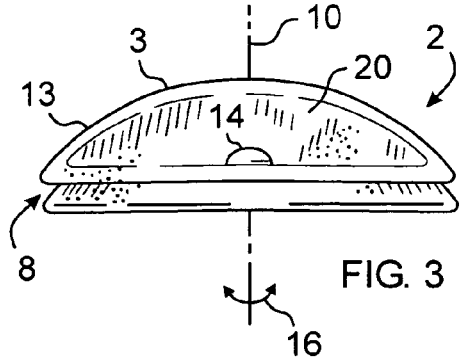
FIG. 3 is a front plan view of the protector of FIG. 2.

Referring now to the drawing, there is shown in FIG. 1 a user's headgear in the form of a paintball mask 1 including an embodiment of the invention designed specifically to provide protection for the user's ear while allowing passage of sound therethrough and providing the user with a means for selecting a direction of boosted sound response. For clarity, in this embodiment, the protector is described while in an angular orientation which boost sounds arriving from in front of a user's face. Those skilled in the art will readily appreciate that the orientation is swivelingly adjustable.

An adjustably mounted protector 2 comprises a substantially disk-shaped body 3 swivelingly mounted within a substantially circular aperture 4 extending through from an outer surface 5 to an inner surface 6 of a portion 7 of a mask located near or positioned over a user's ear. The protector is formed to have a peripheral channel 8 in which rides within the corresponding edge 9 of the aperture in the mask to allow swiveling movement about an axis 10 of rotation which is generally normal to the surface of the mask and thereby intersects it. The protector has, therefore, an inner surface 12 facing the user's ear and an opposite outer surface 13. A user-manipulable actuator nib 14 extends axially outwardly from a peripheral portion 15 of the outer surface of the protector. In this way, a user's finger can touch upon the nib and provide torque for moving the protector in an an angularly adjusting or swiveling motion 16 about the axis 10. In this way, the user can select the direction from which sounds will be boosted and those that will be attenuated.

The protector has an outer surface which is formed into a substantially parabolic reflector 20 oriented to capture sounds arriving from a direction which is substantially perpendicular to the axis of rotation 10. The reflector magnifies sound levels for sounds arriving from a particular direction 19 and correspondingly attenuates sound levels arriving from other directions thereby directing sound from the preferred direction onto the holes. A series of holes 21, 22, 23 located in front of the concave side of the reflector and penetrating through from the outer 13 to inner 12 surfaces allow passage of sound therethrough. The size of the holes is selected to allow passage of sound but to reduce the ability of significant amounts of paint, mud or other matter to pass through. Therefore, the diameter of the holes are preferably selected to be between 1 and 5 millimeters and more preferably between 2 and 5 millimeters. Most preferably, the holes will have a range of sizes, wherein a first series or grouping 21 of holes oriented in an arc congruent with the curve of the reflector have a relatively larger diameter and are placed close to the reflector since the raised porton 24 of the protector behind the reflector blocks fluid arriving from behind the reflector. A second 22 and third 23 series or grouping of holes each oriented in an arc have a diameter which is successively reduced as the distance "d" from the reflector surface increases. In other words, hole diameter is inversely proportional to the probability of impacted paint upon the location of the hole. In this way, the cummulative size of the holes can be maximized for sound through-put while maintaining the adequate protection from the passage of particulate matter according to the probablistic direction of incidence of that matter.

Figure 5:
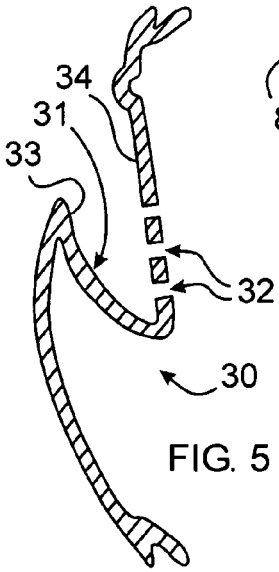
FIG. 5 is a diagrammatic cross-sectional bottom view of a alternate embodiment of the protector.

Referring now to FIG. 5, there is shown an alternate embodiment of the protector 30 wherein the reflector is formed to have a reflective surface 31 which has a portion 33 oriented substantially parallel to the outer surface 34 of the protector body so that it extends radially to axially cover over the holes 32 to provide additional protection and greater selectivity of sound reinforcement. The protector is preferably injected molded from a durable rigid plastic material such as polyvinyl chloride. For injecting molding purposes, the embodiment of FIGS. 1-4 is preferable to reduce manufacturing costs.

While the preferred embodiment of the invention has been described, modifications can be made and other embodiments may be devised without departing from the spirit of the invention and the scope of the appended claims.

What is claimed is:

1. A sound transmissive ear protector for protective headgear, said protector comprises:

a body having an outer surface and an inner surface;

said body being shaped to have a plurality of holes extending from an outer surface of said body to an inner surface of said body; and means for directing sound from a first direction toward said holes;

wherein said means comprise a reflector structure extending from said body and having a portion in an orientation substantially parallel to said outer surface;

wherein a diameter of each of said holes is inversely proportional to its distance from said reflector.

2. A sound transmissive ear protector for protective headgear, said protector comprises:

a body having an outer surface and an inner surface;

said body being shaped to have a plurality of holes extending from an outer surface of said body to an inner surface of said body; and means for directing sound from a first direction toward said holes;

wherein said means comprise a reflector structure extending from said body and having a portion in an orientation substantially parallel to said outer surface;

wherein said reflector is shaped to have a first surface extending to axially cover over a first subset of said plurality of holes.

* * * * *